US005165274A

United States Patent [19]

Thiercelin

[11] Patent Number: 5,165,274

[45] Date of Patent: Nov. 24, 1992

[54] DOWNHOLE PENETROMETER

[75] Inventor: Marc J. Thiercelin, Cambridge, England

[73] Assignee: Schlumberger Technology Corporation, Houston, Tex.

[21] Appl. No.: 802,382

[22] Filed: Dec. 4, 1991

[30] Foreign Application Priority Data

Dec. 11, 1990 [GB] United Kingdom ..... 9026846

[51] Int. Cl.[5] ..... E21B 49/00

[52] U.S. Cl. ..... 73/151; 73/784

[58] Field of Search ..... 73/151, 152, 81, 84, 73/85, 784; 175/50; 166/250, 100, 101

[56] References Cited

U.S. PATENT DOCUMENTS

| | | | |
|---|---|---|---|
| 2,927,459 | 3/1960 | Farrington | 73/151 |
| 3,872,717 | 3/1975 | Fox | 73/84 |
| 3,934,468 | 1/1976 | Brieger | 73/155 |
| 4,149,409 | 4/1979 | Serata | 73/151 |
| 4,461,171 | 7/1984 | de la Cruz | 73/151 |
| 4,806,153 | 2/1989 | Sakai et al. | 73/151 |
| 4,843,878 | 7/1989 | Purfurst et al. | 73/155 |
| 4,860,581 | 8/1989 | Zimmerman et al. | 73/155 |
| 4,936,139 | 6/1990 | Zimmerman et al. | 73/155 |
| 5,042,595 | 8/1991 | Ladanyi | 73/84 X |

FOREIGN PATENT DOCUMENTS

| | | | |
|---|---|---|---|
| 0845425 | 7/1952 | Fed. Rep. of Germany | 73/84 |
| 0567993 | 8/1977 | U.S.S.R. | 73/151 |

OTHER PUBLICATIONS

Proc. of 8th Drilling and Blasting Symp., University of Minnesota, 1958, 1A-22A, and Trans. A.I.M.E., 232 pp. II-327 II-332.

"Poro-elastic Response of a Borehole in a Non-hydrostatic Stress Field", Int. J. Rock Mechanics, vol 25, 3, 1988.

*Primary Examiner*—Hezron E. Williams
*Assistant Examiner*—Michael Brock
*Attorney, Agent, or Firm*—John J. Ryberg; Martin Hyden

[57] ABSTRACT

A downhole penetrometer comprising a body which can be lowered into a borehole and including a tooth and an associated actuator for moving the tooth radially outwardly from the body so as to penetrate the wall of the borehole, a sensing arrangement being provided for determining the force applied to the tooth and the extent of penetration of the tooth into the borehole wall. A motor and pump arrangement is included to power the actuator, power typically being provided by a wireline which can also be used to communicate readings to the surface. A pair of inflatable packer modules are situated above and below the tooth to isolate an interval of the borehole in which a measurement is being made.

10 Claims, 4 Drawing Sheets

DOWNHOLE PENETROMETER

The present invention relates to a downhole penetrometer for measurements of rock to allow calculation of rock cohesion, rock internal friction angle and pore pressure variation with depth.

Models which can be used to predict the stability of a well require knowledge of the rock failure behaviour which is often described by two parameters: the rock cohesion c and rock angle of internal friction $\phi$. The determination of these two parameters has been obtained by carrying out laboratory triaxial tests on core samples which have been retrieved downhole. The cost of the downhole coring procedure and the fact that these laboratory tests are extremely time consuming and cannot be done on site prevent this estimation being commonly done. It is also sometimes difficult to retrieve relevant samples from the formation of interest if the coring procedure is damaging to the rock. The damage is often due to the initiation of micro-cracks which are induced by the relief of the state of stress, but could also be of a chemical nature, for example if the rock is sensitive to water.

To avoid the difficulties associated with laboratory measurements, techniques have been developed to determine the rock cohesion from a wireline log response. These techniques use correlations which have been established in sandstone between the cohesion, Young's modulus and the clay content. This approach allows the determination of the cohesion because clay content and elastic constant can be obtained from wireline logs. However, this determination is much less accurate than a determination based on direct measurements. Furthermore, the correlations have only been established in sandstones and only concern the rock cohesion. They do not provide an estimation of the internal friction angle of the rock.

The determination of pore pressure in low permeability rocks such as shales can also be critical to the success of drilling operations as well as to the efficiency of hydraulic fracturing stimulations. For example, the knowledge of pore pressure is required in kick control to predict overpressurised zones; wellbore stability and stress estimation require the knowledge of total stress and pore pressure. However, although this determination is essential to the oil industry, the techniques and tools developed to measure pore pressure in reservoirs such as the Repeat Formation Tester Tool from Schlumberger (RFT) are not applicable to low permeability rocks because of the low diffusivity of the saturated fluid.

It has been previously proposed to determine the cohesion and angle of internal friction by interpreting load/penetration curves obtained during identification of samples. U.S. Pat. No. 4,806,153 proposes a method and apparatus for downhole identification testing wherein a test device is forced downwardly into the base of a hole to obtain measurements. Such an approach is only practicable for relatively shallow holes and is not suitable for very deep boreholes such as are encountered in the oil industry as only one measurement can be made at the bottom of the borehole which would necessitate the cessation of drilling operations for each separate measurement made. Formation testing apparatus is described in U.S. Pat. No. 3,934,468, in which a test probe is extended into the borehole wall to obtain a sample of connate fluid and a measure of the pressure thereof. Again only one measurement is possible with this apparatus.

U.S. Pat. No. 4,149,409 describes a borehole stress property measuring system including a cylindrical member which is placed in a borehole and has pairs of opposed pistons which project from the member and are operated via a surface mounted fluid pump to engage and deform the borehole wall. The objective of this system is to deform the wellbore to determine properties and suffers from accuracy problems if the pump is separated by a great distance from the tool.

It is an object of the present invention to provide a downhole tool which can be used to measure rock cohesion, internal friction angle and pore pressure at varying depths with reasonable accuracy.

It is also an object of the present invention to provide apparatus which can provide a series of indentation measurements at various depths in a borehole. The object is achieved by providing an arrangement in which a penetrometer tooth can be driven radially into the borehole wall.

In accordance with the present invention, there is provided a downhole penetrometer comprising a tool body which can be lowered into a borehole, the tool body including a tooth member and an associated fluid pressure operated actuator for moving the tooth member radially outwardly from the body, sensing means being provided for determining the force applied to the tooth member by the actuator and for determining the amount of movement of the tooth member, characterised in that the tool body includes pumping means to supply pressurised fluid to the actuator, the tooth member being moveable so as to penetrate the wall of the borehole, the sensing means determining the extent of penetration of the tooth member into the wall of the borehole.

Power is typically provided by a wireline which can also be used to communicate readings to the surface. The force sensor can typically comprise a pressure sensor.

It is preferred that means are included to isolate an interval of the borehole in which a measurement is being made. These typically comprise a pair of inflatable packer modules, situated above and below the tooth. It is also preferred that the isolated test interval can be pumped to a different pressure to the remainder of the borehole.

The penetrometer should preferably include some means to ensure that it is central in the borehole and oppose reaction to the tooth penetration. This can be achieved by providing one or more anchor members which bear against the borehole wall. Alternatively, several teeth can be arranged radially around the body and simultaneous measurements made from all teeth.

The present invention will now be described with reference to the accompanying drawings, in which.

Figure 1:
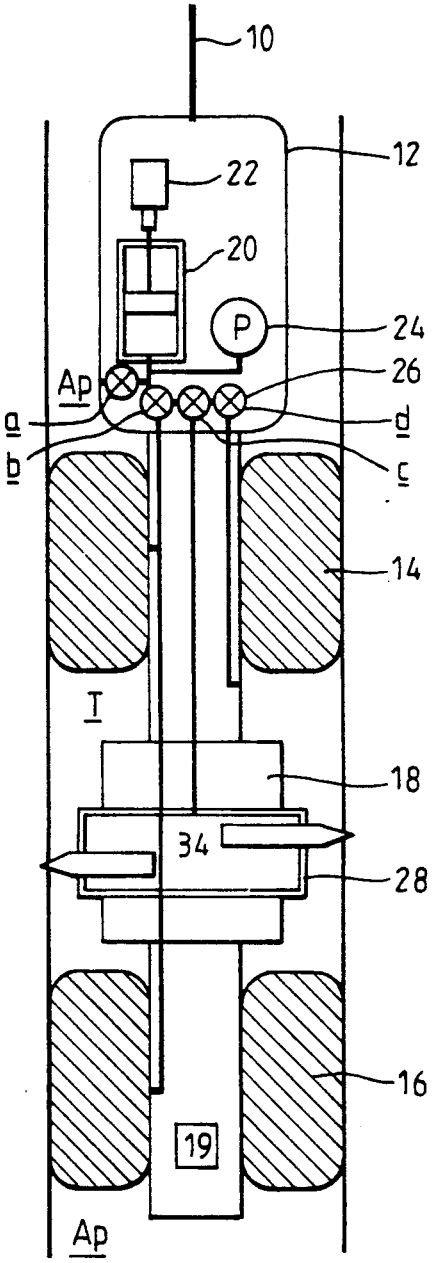
FIG. 1 shows a diagramatic view of a penetrometer tool according to one embodiment of the invention.

Referring now to FIG. 1, the tool shown therein is a downhole tool which can be lowered into the wellbore by a wireline 10. The wireline connection to the tool and the power supply and communication related electronics are not illustrated for the purpose of clarity and are of a similar design as the ones used with other similar downhole tools. The tool comprises four modules: a pump out module 12, two packer modules 14, 16 and a penetrometer module 18. The tool can be assembled without the packer modules 14, 16 which are not always required and can optionally include a unit to measure tool orientation 19. The packer modules 14, 16 allow a portion of the borehole (the test interval T) to be isolated and pressurised at a pressure higher or lower than the annulus pressure $A_p$. The pump out module 12 comprises a pump 20 which is actuated by a motor 22, a pressure gauge 24 and the necessary valves 26. The pump 20 is used to inflate the packers 12, 16, pressurise the test interval T and actuate the penetrometer module 18.

Figure 2:
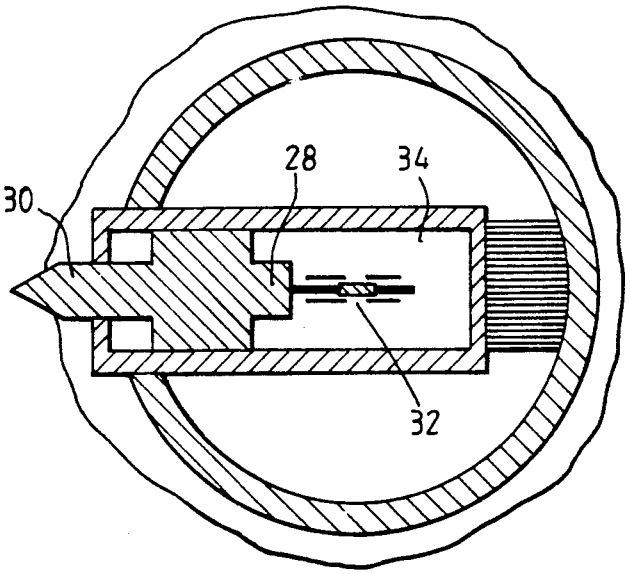
FIG. 2 shows a cross section of a penetrometer module.

The penetrometer module 18 is mounted between the two packer modules 14, 16 and is shown in cross section in FIG. 2. The penetrometer module 18 is essentially composed of units 28 of indentors. A unit can be composed of one indentor extending into an actuator chamber 34 and an anchor mounted diametrically opposite to the indentor, two indentors mounted diametrically opposite each other, or four indentors mounted at right angles to each other. These designs are required to equilibrate the loads. The displacement of each indentor is measured using an LVDT 32 or other displacement caliper which can also measure the distance between the tool and the borewall. The pressure which is required to displace the indentors into the rock is applied at the same time to the complete set of indentors. The pressure is preferably increased by imposing a constant displacement to the pump 20 and is measured by the pressure gauge 24 in the pump out module 12. A tooth 30 of given shape is mounted on the indentor. The tooth can have the shape of a wedge or a cone and preferably includes a flat (not shown) in order to enable the measurement rock elasticity. The pressure in the chamber versus the displacement of the indentors is recorded during the increase of pressure in the chamber 34. The valves 26 comprise four remotely operable valves 26 a-d which allow communication of the pump 20 with the annulus A, the packer modules 14, 16, the chamber(s) 34 and the test interval T respectively.

Figure 3:
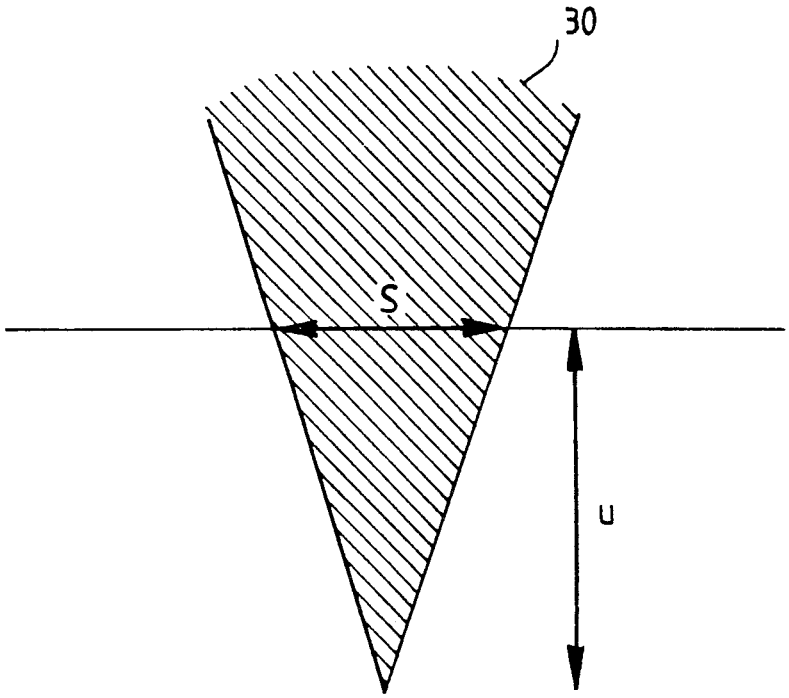
FIG. 3 shows a tooth cross section.

The determination of the cohesion and angle of internal friction angle is based on the interpretation of the load penetration curves which are obtained during the rock indentation. In order to quantify the indentation response the mean pressure $p_m$ which is acting normal to the original specimen surface is used. The mean pressure has been defined for ideal plastic materials which exhibit a linear load penetration curve when indented by a sharp wedge. For these materials, the mean pressure is:

$$p_m = F(u)/S(u)$$

where:

F(u) is the load;

S(u) is the tooth cross section at the original specimen surface (FIG. 3).

S(u) is a function of the displacement and the geometry of the tooth. For example, for a wedge shaped tooth S is given by:

$$S(u) = 2w\ tan(\alpha)u$$

where:

u is the depth of penetration;

$\alpha$ is the semi-angle of the wedge;

w is the width of the wedge.

Figure 4:
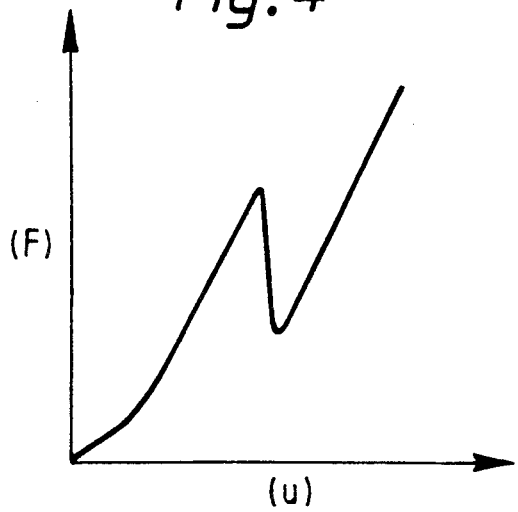
FIG. 4 shows a typical load (F)/penetration (u) plot for a rock.
Figure 5:
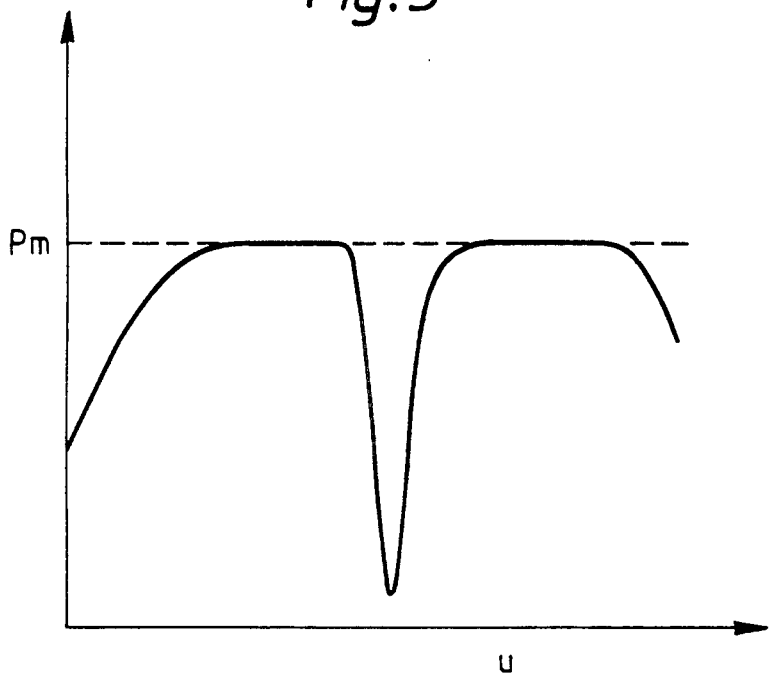
FIG. 5 shows a typical mean pressure ($p_m$)/penetration (u) plot.

However, in rocks the load penetration curve is composed of loading sections and unloading sections (FIG. 4). The last section corresponds to the formation of chips of the rock and cannot be used to measure the rock cohesion and friction of internal angle. To keep the notion of measuring a plastic deformation, we define the mean pressure as:

$$P_m(u) = \frac{\delta F(u)}{\delta u} \frac{1}{S(u)} \tag{1}$$

on the loading portions where the mean pressure is constant (FIG. 5). The mean pressure has the dimensions of hardness and the value is identified to the relevant rock strength parameters with the help of a plastic model: for example, for a rock which follows a Mohr-Coulomb failure behaviour the mean pressure is given by:

$$pm = 2\{c + (p_{mud} - p_O)tan(\phi)\}G(\phi,\alpha) \tag{2}$$

where $p_{mud}$ is the mud pressure and $p_o$ the pore pressure. $G(\phi,\alpha)$ is a known function of the internal friction of the rock and the tooth angle.

Using the Cheatham model (Proc. of 8th Drilling and Blasting Symp., University of Minnesota, 1958, 1A-22A, and Trans. A.I.M.E., 232 pp II-327 II-332.) of a wedge with a rough tooth-rock interface provides a satisfactory description of rocks and gives:

$$G = \frac{1}{2w \tan \alpha}\left\{\left(1 + \frac{\tan \alpha}{\tan \phi}\right)(1 + \sin \phi)\, e^{\omega} - \frac{\tan \alpha}{\tan \phi}\right\} \tag{3}$$

where $$\omega = 2\left(\alpha + \frac{\pi}{4} + \frac{\phi}{2}\right)\tan \phi \tag{4}$$

The value of $p_m$ is measured at two different values of mud pressure. At the loading rate achieved by the equipment, $p_o$ will remain constant during the test, therefore one obtains:

$$p_m^1 - p_m^2 = (p_{mud}^1 - p_{mud}^2)\tan(\phi)G(\phi, \beta) \tag{5}$$

This formula, once inverted, allows the determination of the value of $\phi$. Once $\phi$ is known, c is easily obtained.

Figure 6:
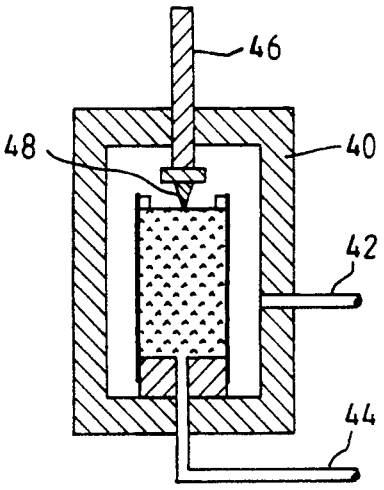
FIG. 6 shows an experimental rig used to determine the effects of penetration testing.

The behaviour of the apparatus according to the present invention can be determined from the experimental rig shown in FIG. 6.

In the test rig shown in FIG. 6, an indentation cell is used to indent shale samples at displacement rates up to 1 mm/min. This equipment comprises a 60 MPa cell 40, a 200 kN Instron mechanical load frame (not shown), a servo-controlled confining pressure system 42 and a servo-controlled pore pressure system 44. A stepmotor pump (not shown) is used to control the pore pressure and has a displaced volume of 5 ml. The cell allows application of confining pressure (ie the simulated mud pressure) and pore pressure up to 60 MPa to a 6 inch diameter sample. With this cell the simulated mud pressure is equal to the confining pressure. The cell is mounted into the Instron load frame which is used to apply a load to a rod 46 on which is attached a tooth 48. Experiments are performed at a constant displacement rate and HP 9836 computer is used to control the load frame and to acquire data during the test. The tooth can be attached to the rod eccentrically allowing up to eight indents into the rock to be performed by rotation of the rod, without dismounting the sample or releasing the pressure. During the test the volume of the rod which is inside the cell increases. Therefore, the servo-controlled system 42 for the confining pressure must remove some confining fluid to maintain a constant confining pressure. The specimens of 2 inches and 6 inches in diameter are cored from pieces of shale which have been stored under tap water, using diamond core barrels with water lubrication. Coring is done perpendicular to the bedding plane to provide a rock surface to be indented parallel to these bedding planes. The samples are then cut and the tests prepared.

Figure 7:
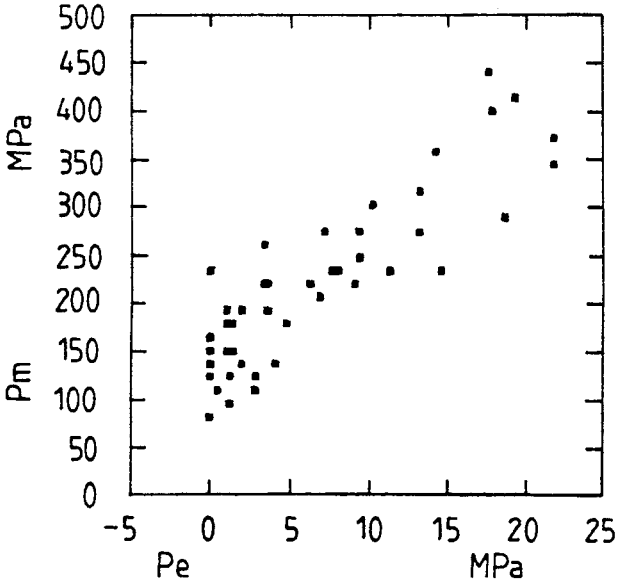
FIG. 7 shows a plot of mean pressure ($p_m$) as a function of effective pressure ($p_e$) obtained on the apparatus of FIG. 6.

A specific test example is shown in FIG. 7 and due to the large number of data available a linear regression technique is used. $p_e$ is the effective pressure i.e. the mud pressure minus the pore pressure and $p_m$ the mean pressure in MPa. The tooth angle is 40 degree and the tooth width is 10 mm.

From this example it is found that:

$$p_m = 141 + 11.9 p_e \tag{6}$$

Figure 8:
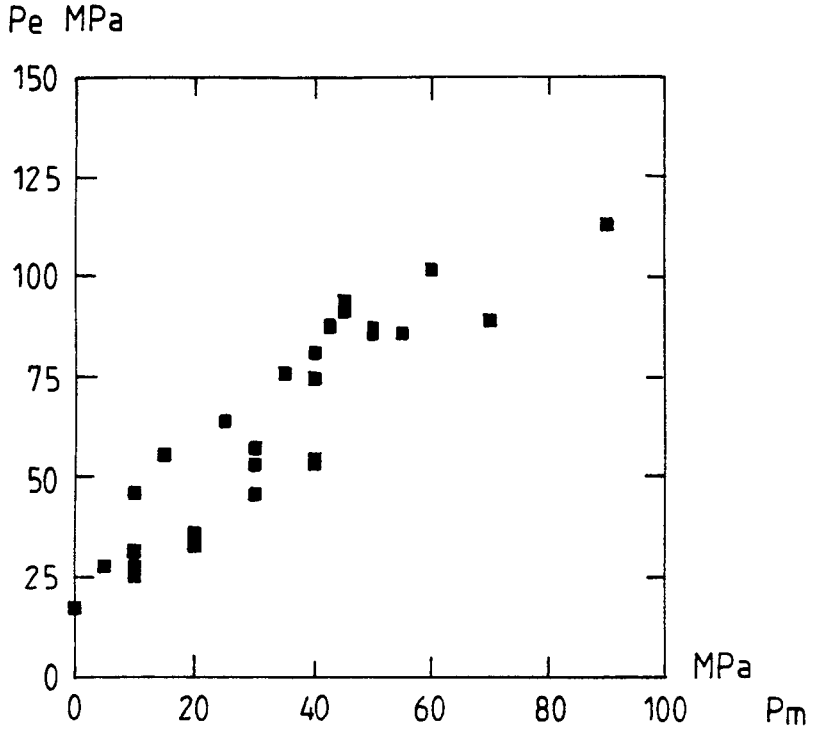
FIG. 8 shows a corresponding plot to FIG. 7 but obtained by the prior art triaxial testing method.

Using the Cheatham solution it is found that $\phi = 26$ degree and $c = 6$ MPa, which compares well with a determination using triaxial tests which were carried out on the same lithology (a jurassic shale) which gave $\phi = 22 \pm 2$ degree and $c = 8 \pm 3$ MPa (FIG. 8). In this Figure, the peak strength is plotted as a function of effective pressure. The uniaxial strength Cu is the value of peak strength at zero confining pressure and the cohesion c is found from:

$$2c = Cu(1 - \sin\phi)/\cos\phi \tag{7}$$

It often happens that the pore pressure is unknown. It should be recognized that, in the theory of elasticity, an increase of the mud pressure in the well should not generate a change in the value of the pore pressure, hence the determination of $\phi$ proposed in the previous section remains valid. This is particularly true in permeable rocks for which a drilling mud cake builds up, preventing the mud penetrating the formation. If a knowledge of the cohesion is required, a decrease of the mud pressure in the test interval will result in the destruction of the mud cake and the invasion of the formation fluid in the test interval. The mud pressure becomes equal to the pore pressure near the well bore and the term $p_{mud}$- $p_o$ cancelled out, allowing the cohesion to be measured.

The situation is more complex in low permeability shales for which a mud cake does not build up or is inefficient. A variation of the mud pressure could also produce an instantaneous variation of the pore pressure near the well bore in plastic rocks. Under this condition the value of the pore pressure near the wellbore is not necessarily the far-field pore pressure but is a combination of the far field pore pressure, the mud pressure, the distance from the wellbore and the time. Therefore the pore pressure is an unknown and the indentation response is going to be used to estimate the value of the pore pressure. The use of a packer arrangement is not required in this situation.

The approach which is taken is to assume a default value of the friction angle for the shale under consideration, because it has been observed that in most of the cases the friction angle for shales lies between 20 and 25 degrees. Estimation of the friction angle from the drilling response could also be used. Indentation as soon as possible after the formation has been drilled (less than two hours) and up to a reasonable depth (say 5 cm) is also recommended to minimize the effect of mud invasion in shale. Knowledge of the azimuthal direction of the indentation is also recommended because it may be possible to observe an azimuthal variation of indentation response. This variation will be related to the azimuthal variation of the pore pressure which is generated during the creation of the hole when the far-field state of stress is not isotropic (see E Detournay and A Cheng, "Poro-elastic Response of a Borehole in a Non-hydrostatic Stress Field", Int. J. Rock Mechanics, Vol 25, 3, 1988). However the strength of the azimuthal variation should decay with time.

With an assumption on the value of the angle of internal friction, the indentation response becomes a linear function of the pore pressure and the cohesion. Indentation responses obtained at various depths in the same lithology will show large variation of the cohesion. This is typically the case of the experimental data shown on FIG. 7. The scattering of the data which is observed on this Figure is essentially due to a local variation of the cohesion rather than to a local variation of the friction angle (the scattering of the data does not increase with the value of the effective pressure). In order to recover the actual value of the cohesion and in-situ pore pressure, linear optimisation techniques on the set of indentation responses are carried out. The technique of linear programming which is described in "Numerical Recipe" by W H Press et al is considered appropriate. This technique maximizes (or minimizes) a function subject to given constraints. It requires the variables to be positive, which is the case as the cohesion and the pore pressure are always positive. The function to minimize is the sum of the predicted responses minus the sum of the indentation response:

$$Z = \Sigma p_{mi} - \Sigma 2\{C(i) - (p_{mud}(i) - p_o(i)) \tan\phi\} G(\phi, \alpha) \tag{8}$$

in which i means a given penetration.

If the set of indentations are performed within a 5 feet interval, the pore pressure can be assumed to be constant (5 feet produced a variation of pore pressure of the order of 2 psi; this is negligible compared to the actual value of the pore pressure, which is of the order of 1000s of psi. Thus:

$$Z = \Sigma p_{mi} - \Sigma 2\{C(i) - (p_{mud} - p_o) \tan\phi\} G(\phi, \alpha) \tag{9}$$

For the particular problem, the additional constraints are a pore pressure ranging from the hydrostatic pressure to the overburden, an estimated maximum value of the cohesion, and the values of the indentation response at each depth. The optimisation gives the value of the cohesions c(i) and the value of the pore pressure. Actually $\phi$ could also be entered as an unknown in the optimisation technique. However, non-linear optimisation techniques have then to be used.

The constraints imposed in the technique could be more severe if the rock type is known. To improve the accuracy of the determination especially when the internal angle of friction may not be assumed constant other relationships could be used. For example it has been found that within the same lithology the cohesion of a shale is a function of the porosity. Therefore the following relationship:

$$c(i)=K\Phi(i)+k_o \quad (10)$$

can be used where $\Phi$ is the porosity obtained from a wireline log and k and $k_o$ are constants which have to be determined. In the above equation $\Phi$ can be replaced by the Young's modulus of the rock which can be determined directly by the indentor:

$$c=k'E+k_o' \quad (11)$$

Figure 9:
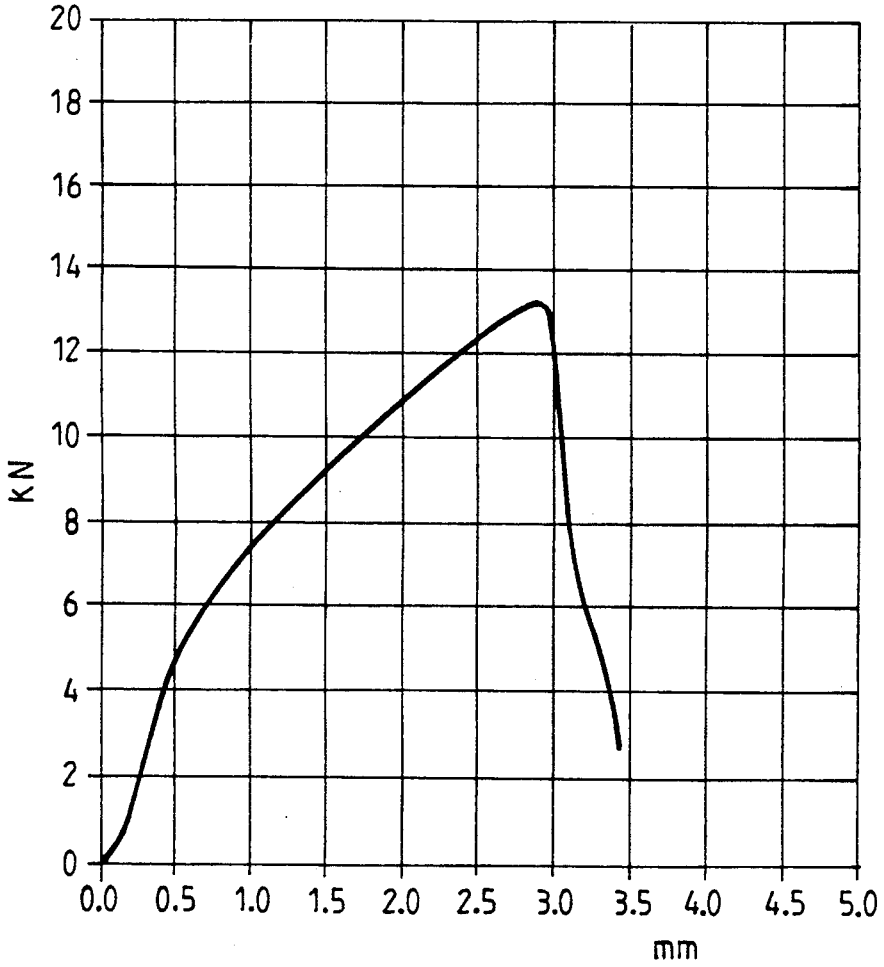
FIG. 9 shows a specific example of a load (kN)/penetration plot (mm) obtained in the apparatus of FIG. 6.

For this determination, the relationship between the load and the penetration obtained during an elastic deformation is used. For example, if the tooth has a flat, the load is elastically linearly related to the displacement at the beginning of the loading (FIG. 9). The slope is a linear function of the inverse of the Young's modulus.

FIG. 9 represents the load penetration curve obtained from Richemont Limestone b43 for a 40° 4 mm blunt indentor extended at 100 mm/min.

As will be appreciated from the above, for the determination of the parameters of interest generally requires knowledge of one parameter so that the then two can be derived from the results and the formulae given above. Generally, it is the pore pressure $p_o$ which is known or which can be estimated from observations at other times or locations which are similar to the case under investigation. Alternatively, an estimated value for one parameter can be used which can still give results of sufficient accuracy.

I claim:

1. A downhole penetrometer for making earth stress measurements comprising a tool body which can be lowered into a borehole and comprising:

a) fluid pressure operated actuator means, b) a tooth member connected to said actuator means so as to be moveable radially outwardly from said body so as to penetrate a wall of the borehole, c) sensing means for determining the force applied to said tooth member by said actuator means, d) sensing means for determining the amount of movement of said tooth member, e) pumping means to supply pressurised fluid to said actuator means, and f) means for isolating a region of the borehole in which measurements are to be made from the remainder of the borehole said tooth member being moveable so as to penetrate the wall of the borehole, and said sensing means together determining the extent of penetration of the tooth member into the wall of the borehole.

2. A penetrometer as claimed in claim 1, wherein said means for isolating a region of the borehole comprise a pair of inflatable packers.

3. A penetrometer as claimed in claim 1, wherein said pumping means is provided with means to maintain the isolated region at a different pressure to the remainder of the borehole.

4. A penetrometer as claimed in claim 1, wherein a pressure sensor is provided to monitor the pressure of fluid provided to said actuator in order to determine the force applied to said tooth member.

5. A penetrometer as claimed in claim 1, wherein one or more locating members are provided to engage the borehole wall and to maintain the body in a substantially central position in the borehole.

6. A penetrometer as claimed in claim 5, wherein said one or more locating members are further tooth members with associated actuator means and sensing means are provided to measure the force applied and the extension of each tooth member.

7. A penetrometer as claimed in claim 1, wherein the body is provided with a connection from a wireline to communicate directly when in use to the surface.

8. A penetrometer as claimed in claim 1, wherein said tooth member is wedge shaped.

9. A penetrometer as claimed in claim 1, further including a sensor for measuring the orientation of the body.

10. A penetrometer as claimed in claim 1, wherein said tooth member is cone shaped.

* * * * *